US010925362B1

(12) United States Patent
Luo

(10) Patent No.: US 10,925,362 B1
(45) Date of Patent: Feb. 23, 2021

(54) HAND-OPERATED CANTILEVER UMBRELLA

(71) Applicant: Tempo Manufacturing LLC, Nantong (CN)

(72) Inventor: Xiong Luo, Nantong (CN)

(73) Assignee: Tempo Manufacturing LLC, Nantong (CN)

( * ) Notice: Subject to any disclaimer, the term of this patent is extended or adjusted under 35 U.S.C. 154(b) by 0 days.

(21) Appl. No.: 16/842,453

(22) Filed: Apr. 7, 2020

(30) Foreign Application Priority Data

Dec. 30, 2019 (CN) ..... 201911389861.2

(51) Int. Cl.
*A45B 23/00* (2006.01)

(52) U.S. Cl.
CPC ..... *A45B 23/00* (2013.01); *A45B 2023/0037* (2013.01); *A45B 2023/0068* (2013.01); *A45B 2023/0075* (2013.01)

(58) Field of Classification Search
CPC ..... A45B 23/00; A45B 2023/0056; A45B 2023/0081; A45B 2023/0068; A45B 2023/0037
See application file for complete search history.

(56) References Cited

U.S. PATENT DOCUMENTS

| | | | | |
|---|---|---|---|---|
| 6,588,438 | B1 * | 7/2003 | Steiner | A45B 23/00 135/20.1 |
| 8,104,492 | B2 * | 1/2012 | Dan | A45B 23/00 135/20.3 |
| 9,167,873 | B2 * | 10/2015 | May | A45B 23/00 |
| 9,289,038 | B2 * | 3/2016 | Ma | A45B 23/00 |
| 10,758,016 | B1 * | 9/2020 | Wang | A45B 25/08 |
| 2015/0068566 | A1 * | 3/2015 | Ma | A45B 23/00 135/20.1 |

* cited by examiner

*Primary Examiner* — Noah Chandler Hawk
(74) *Attorney, Agent, or Firm* — Wang Law Firm, Inc.

(57) ABSTRACT

A hand-operated cantilever umbrella includes a vertical column (1), a transverse rod (2), a drawing rod (3), an umbrella frame (4) and an umbrella adjustment mechanism (5). The bottom end of the transverse rod (2) is hinged to the slider disposed on the vertical column (1), the umbrella frame (4) hinged to the top end of the transverse rod (2), a large rib connector (470) and a drawing rod connector (30) are rotatably disposed on the middle portion of the transverse rod (2). The large rib connector (470) has a stopper (471) resisting against the drawing rod connector (30). The present invention is simple and rational in structure, and the open and fold operation is more convenient and quick, moreover, since the product does not need any rope to withstand wind in the open process and the subsequent use stage, it is more labor-saving to open, higher in strength and more stable in structure.

9 Claims, 7 Drawing Sheets

HAND-OPERATED CANTILEVER UMBRELLA

RELATE APPLICATION

This application claims the priority benefit of China Application serial no. 201911389861.2, filed on Dec. 30, 2019. The entirety of the above-mentioned application is incorporated here by this reference and made a part of this specification

TECHNICAL FIELD OF THE INVENTION

The present invention relates to an umbrella, and in particular to a combined hand-operated cantilever umbrella.

BACKGROUND OF THE INVENTION

As a kind of outdoor leisure items, umbrellas are widely applied in squares, beaches, park, gardens or similar places to shield an individual from sun. Generally, umbrellas include center-support umbrellas and side-support umbrellas. Side support umbrellas include upright-pole cantilever umbrellas which are popular with people due to their convenience in usage, storage and transportation. The demands for such upright-pole cantilever umbrellas are increasing.

Since the umbrellas used outdoor are generally large and high, cantilever umbrellas are mostly folded or unfolded by ropes. It is time-consuming and labor-consuming, less efficient and inconvenient to use, and the strength and length of the rope cannot be accurately controlled. It is possible that the whole product cannot be used due to deficiencies in strength and size of the rope. Moreover, once the product is damaged, it is difficult to maintain or replace the rope inside the product. At present, there are cantilever umbrellas that are not folded or unfolded by ropes. However, due to their structural restrictions, these cantilever umbrellas cannot be adjusted in their angle although they can be folded or unfolded. With the improvement of living standards, umbrellas that have a large canopy and are labor-saving to fold/open and easy to fix become the development trend in future umbrellas.

Upon examination, a Chinese Patent CN204317733U (Patent No.: 201420712088.5) disclosed a hand-operated umbrella, which includes an pole, a upper tray, a lower tray, long ribs and short ribs, wherein the upper tray is fixed at the top end of the pole; the lower tray is movably arranged on the pole; upper ends of the long ribs are mounted on the upper tray; lower ends of the short ribs are mounted on the lower tray; upper ends of the short ribs are hinged to middle portions of the long ribs; wherein, a push member is further sheathed on the pole below the lower tray; the push member is connected to the lower tray through a connecting rod; the push member is moved up and down along the pole to drive the lower tray to move synchronously; and, in an unfolded state, the push member is moved up to a position reachable by a hand of an operator. This umbrella is unfolded or folded by pushing the push member up or down. However, this umbrella is a center-support umbrella rather than a cantilever umbrella and has no any positioning mechanism so that the canopy cannot be well positioned.

Therefore, it is necessary to design a cantilever umbrella that is convenient and labor-saving to open and adjustable in shading angle.

SUMMARY OF THE INVENTION

It is an object of the present invention to provide a combined hand-operated cantilever umbrella which is rational in structure and easy to unfold and fold and can be unfolded without any rope and adjusted in shading angle.

For achieving the object, the hand-operated cantilever umbrella, comprises a vertical column, a transverse rod having a top end, a middle portion and a bottom end, a drawing rod having a front end and a rear end, the drawing rod being movably hinged to a top of the vertical column, an umbrella frame hinged to the top end of the transverse rod, a rope with a first end and a second end running along the transverse rod, and an umbrella adjustment mechanism connected to the transverse rod and sliding along the vertical column, the umbrella adjustment mechanism being capable of adjusting the angle of the umbrella when sliding along the vertical column, wherein, the front end of the drawing rod is hinged to the middle portion of the transverse rod, the umbrella frame further comprises an upper column, an upper runner connected to a top of the upper column, a lower runner sliding along the upper column, a plurality of long ribs movably connected to the upper runner, each long rib having an inner end and a middle portion, a plurality of short ribs movably connected to the lower runner, each short rib having an inner end and an outer end, and a large rib having an inner end and an outer end; the inner end of each long rib is rotatably connected to the upper runner; the outer end of each short rib is rotatably connected to the middle portion of corresponding long rib, and the inner end of each short rib is rotatably connected to the lower runner; the outer end of the large rib is rotatably disposed on the middle portion of the transverse rod, and the inner end of the large rib is rotatably connected to the lower runner, the umbrella adjustment mechanism further comprises a slider movably disposed on the vertical column, a large rib connector being rotatable around a rotating shaft disposed on the middle portion of the transverse rod, and a drawing rod connector rotatably disposed on the middle portion of the transverse rod; the slider is capable of sliding up and down, the bottom end of the transverse rod is hinged to the slider; the outer end of the large rib is connected to the large rib connector, the front end of the drawing rod is connected to the drawing rod connector to be rotatably connected to the transverse rod, the large rib connector has a stopper resisting against the drawing rod connector, when the slider is pushed upward, the drawing rod connector will resist against the stopper and press downward the stopper to drive the large rib connector to rotate about the rotating shaft, so as to drive the large rib and the lower runner to move upward relative to the upper column until the umbrella is open;

A positioning piece for positioning the lower runner out of the upper column is rotatably disposed at the bottom end of the upper column, the positioning piece is capable of rotating between inside and outside the upper column, the first end of the rope is connected to the positioning piece, the second end of the rope runs upward throughout the upper column and then downward throughout the transverse rod and the slider to be exposed outside, when the rope is pulled, the positioning piece will rotate into the upper column, and the lower runner is capable of moving downward and leave apart the upper column so that the umbrella is folded.

Preferably, the upper column is hollow and has an annular wall, the positioning piece has a resisting portion at a middle of the positioning piece, the wall of the upper column has an opening for the resisting portion of the positioning piece to rotate outside, the positioning piece is positioned inside the upper column, and, a first spring resists between the wall of the upper column and the back of the resisting portion of the positioning piece, so as to make the resisting portion of the positioning piece to keep out of the upper column.

Preferably, the transverse rod is hollow; three pulleys are respectively disposed inside the top end and the bottom end of the transverse rod and inside the top of the upper column, the rope runs through all the pulleys in the transverse rod and the upper column to be connected to the bottom of the positioning piece at the side the resisting portion located, and the bottom of the positioning piece is positioned with the wall of the upper column by a pin disposed away from the side the resisting portion located.

Preferably, the transverse rod has a shaft hole for the large rib connector and the drawing rod connector be mounted at the middle portion of the transverse rod, the rotating shaft runs through the middle of the large rib connector, the end of the drawing rod connector and the shaft hole of the transverse rod so as to make the large rib connector and the drawing rod connector rotatable relative to the transverse rod, the stopper and the outer end of the large rib are respectively located at two sides of the rotating shaft, during the open process of the umbrella, the drawing rod and the large rib rotates together, after the umbrella is open, the lower runner is positioned on the upper column by the positioning piece, the large rib and the transverse rod are kept unmoved relative to each other, and, when the slider is pulled down until the stopper separates from the drawing rod connector, the drawing rod can rotate freely relative to the transverse rod, then, the shading angle of the umbrella frame can be adjusted through operating the slider to move up or down along the vertical column.

Preferably, the umbrella frame further comprises a middle runner and multiple support ribs each having an outer end and an inner end, the middle runner is movably disposed on the upper column, the outer end of each support rib is rotatably connected to the top of the long rib, the inner end of each support rib is rotatably connected to the middle runner, a fixed ring is disposed on the upper column below the middle runner, and, a second spring is supported between the fixed ring and the middle runner.

Preferably, the umbrella adjustment mechanism further comprises a button movably disposed on the slider exposed outside and a latch disposed inside the slider, the vertical column has a vertical synchronous belt inside the vertical column, the latch is transversely movable, a first end of the latch is pin jointed with the top of the button, a second end of the latch can be locked with the synchronous belt or separated from the synchronous belt driven by the movement of the button, accordingly, the slider is positioned on the vertical column through the latch locked with the synchronous belt.

Preferably, the slider has a mounting recess for receiving the button, the middle of the button is rotatably mounted on the slider through a connecting pin, and, a third spring is supported between the inner side of the bottom of the button and the slider, so that the top of the button and the first end of the latch are kept to move forward and push the second end of the latch locked with the synchronous belt.

Preferably, the slider is a sliding sleeve which surrounds around the vertical column and is slidable up and down.

Preferably, a top cap is arranged on the top of the vertical column, and the rear end of the drawing rod is hinged to the top cap.

Compared with the prior art, the present invention has the following advantages. In the present invention, a large short rib connector and a drawing rod connector are arranged on the transverse rod and a stopper is arranged on the large short rib connector to come into contact with the drawing rod connector, during the open process, the user only simply push the slider, the synchronous movement of the large short rib and the drawing rod can drive the lower runner to slide up relative to the upper column, finally the umbrella will be open.

In the present invention, a positioning piece is disposed in the upper column, the lower runner can be positioned on the upper column, and, since the positioning piece is connected to the rope, during the folding process, the positioning piece can rotate into the upper column by pulling the rope, therefore the umbrella can be folded.

In the present invention, the middle runner and a second spring are disposed on the upper column, it make the open operation of the umbrella is more labor-saving.

In the present invention, under the design of the umbrella adjustment mechanism, it is convenient to adjust the shading angle of the umbrella frame.

Generally, the cantilever umbrella of the present invention is simple and rational in structure, and the open and fold operation is more convenient and quick, moreover, since the product does not need any rope to withstand wind in the open process and the subsequent use stage, it is more labor-saving to open, higher in strength and more stable in structure.

DETAILED DESCRIPTION OF THE INVENTION

Figure 1:
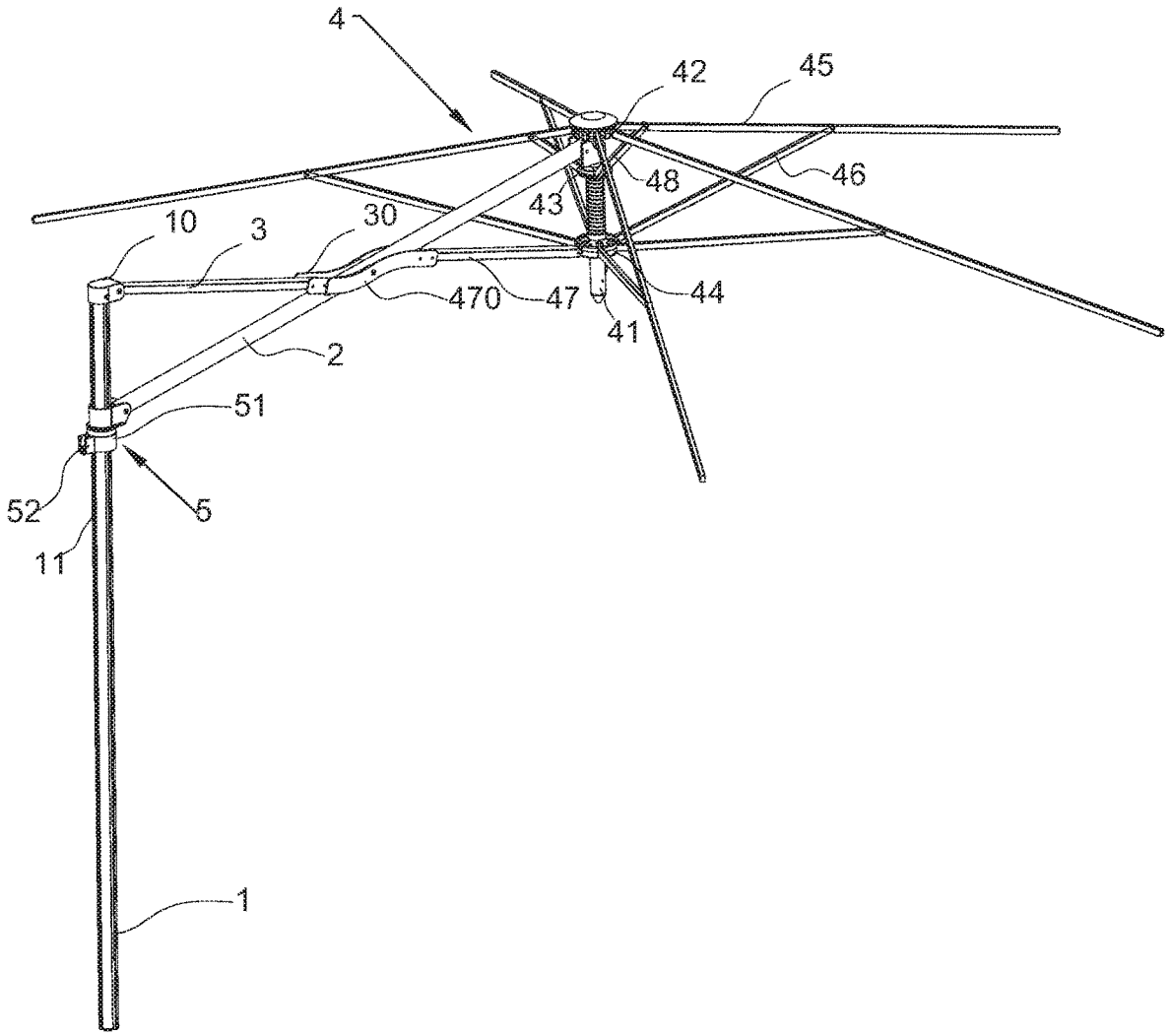
FIG. 1 is a perspective view of a hand-operated cantilever umbrella according to an embodiment of the present invention.
Figure 2:
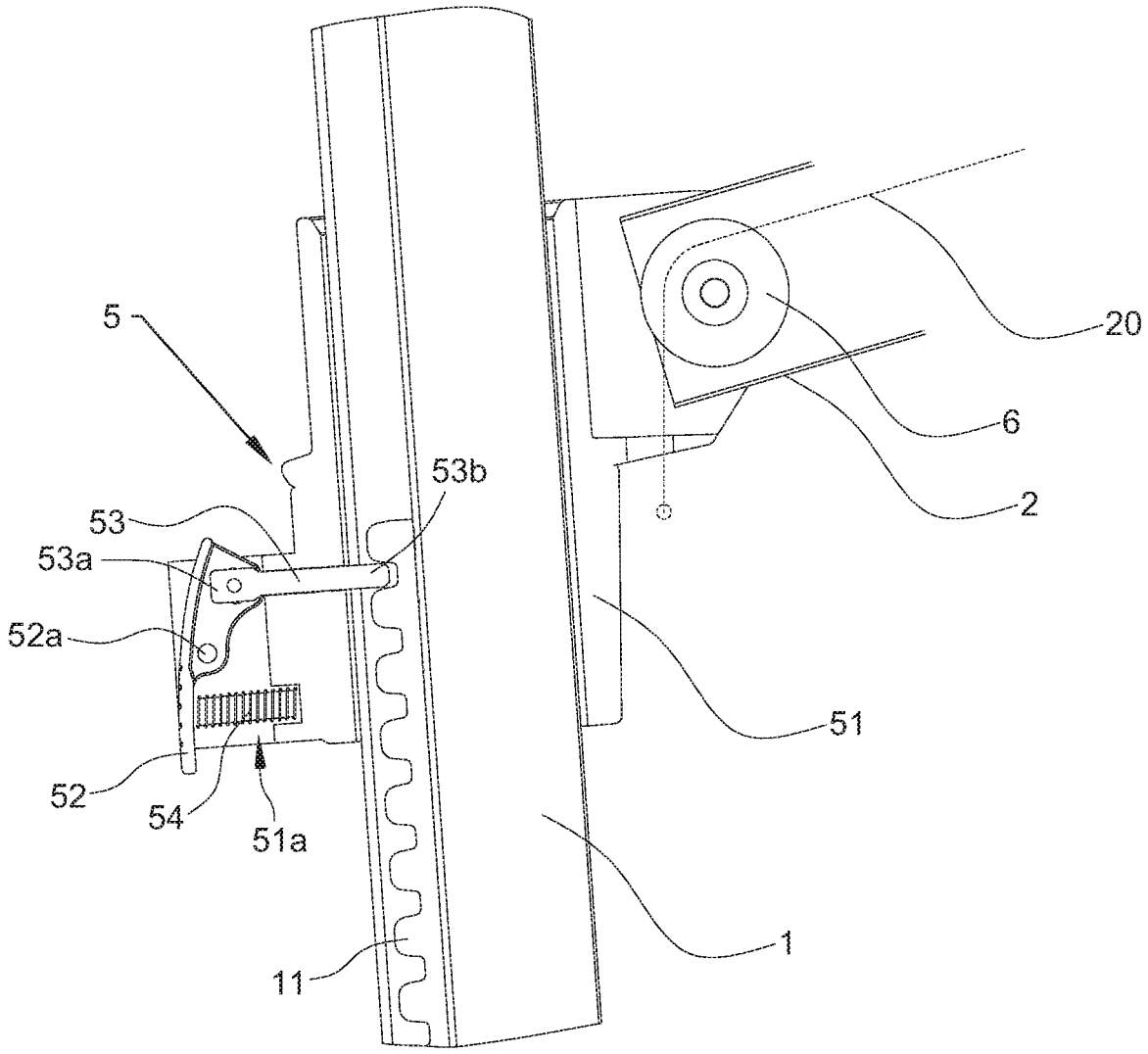
FIG. 2 is a perspective view of the umbrella adjustment mechanism according to the embodiment of the present invention.
Figure 3A:
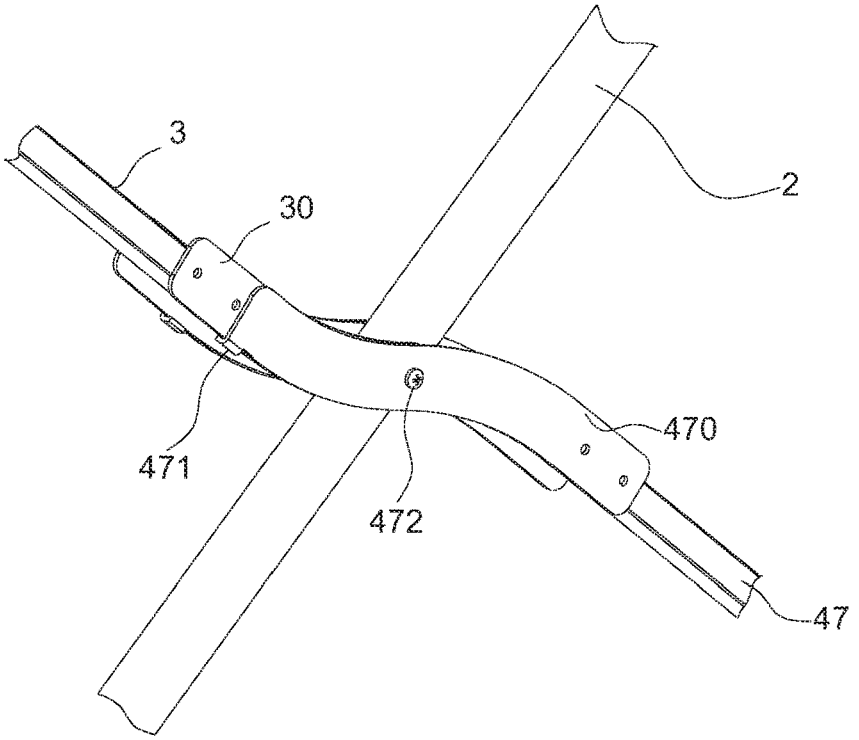
FIGS. 3*a* to 3*b* are the perspective views showing two states of the joint of the drawing rod connector and the large short rib connector according to the embodiment of the present invention.
Figure 3B:
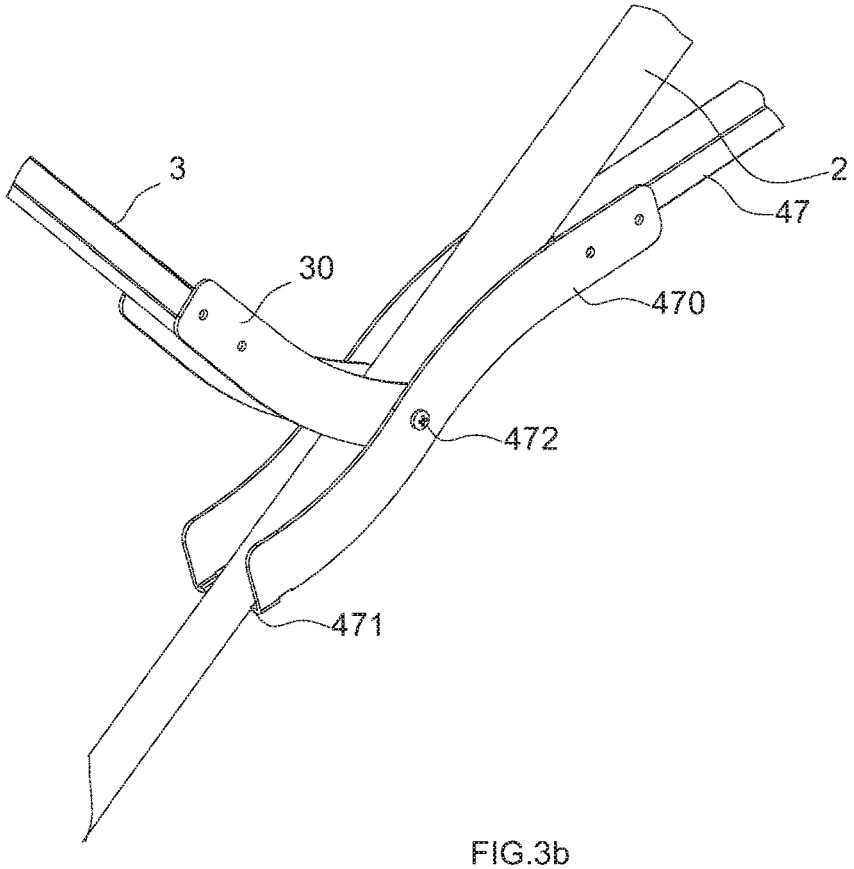

To enable a further understanding of the present invention content of the invention herein, refer to the detailed description of the invention and the accompanying drawings below:

FIGS. 1-6 show a preferred embodiment of the combined hand-operated cantilever umbrella. The umbrella comprises a vertical column 1, a transverse rod 2, a drawing rod 3, an umbrella frame 4 and an umbrella adjustment mechanism 5. The frame 4 comprises an upper column 41, an upper runner 42, a middle runner 43, a lower runner 44, long ribs 45, short ribs 46, a large rib 47 and support ribs 48. A top cap 10 is disposed on the top of the vertical column 1. A large rib connector 470 and a drawing rod connector 30 are mounted in a middle portion of the transverse rod 2. The top end of the transverse rod 2 is hinged to the top of the umbrella frame 4, while a lower end thereof is hinged to the umbrella adjustment mechanism 5. A rear end of the drawing rod 3 is hinged to the top cap 10 on the top of the vertical column 1, while a front end of the drawing rod 3 is fixedly connected to the drawing rod connector 30. The upper column 41 is connected to the upper runner 42. The inner end of each long rib 45 is rotatably connected to the upper runner 42. The outer end of each short rib 46 is rotatably connected to the middle portion of corresponding long rib 45, and the inner end of each short rib 46 is rotatably connected to the lower runner 44. Each outer end of the support ribs 48 is rotatably connected to upper portions of the long ribs 45, while each inner end of the support ribs 48 is rotatably connected to the middle runner 43. The outer end of the large rib 47 is rotatably disposed on the middle portion of the transverse rod 2, and the inner end of the large rib 47 is rotatably connected to the lower runner 44.

The umbrella adjustment mechanism 5 comprises a slider 51, a latch 53 and a button 52. The slider 51 is a sliding sleeve which surrounds around the vertical column 1 and is slidable up and down. The button 52 movably disposed on the slider 51 exposed outside. the vertical column 1 has a vertical synchronous belt 11 inside the vertical column 1. Toothed slots are distributed on the surface of the synchronous belt 11. The latch 53 is transversely movable, a first end 53*a* of the latch 53 is pin jointed with the top of the button 52, a second end 53*b* of the latch 53 can be locked with the synchronous belt 11 or separated from the synchronous belt 11 driven by the movement of the button 52, accordingly, the slider 51 is positioned on the vertical column 1 through the latch 53 locked with the synchronous belt 11. The slider 51 has a mounting recess 51*a* for receiving the button 52, the middle of the button 52 is rotatably mounted on the slider 51 through a connecting pin 52*a*, and, a third spring 54 is supported between the inner side of the bottom of the button 52 and the slider 51, so that the top of the button 52 and the first end 53*a* of the latch 53 are kept to move forward and push the second end 53*b* of the latch 53 locked with the synchronous belt 11. In this way, the slider 51 can be moved up and down simply by pressing the button 52. The umbrella adjustment mechanism 5 is similar to that described in the technical solution of a Chinese Patent CN201846967U, and its specific structure will not be described here.

Both the upper column 41 and the transverse rod 2 are hollow tubes. Pulleys 6 are respectively disposed inside the top end and the bottom end of the transverse rod 2 and inside the top of the upper column 41, respectively. The pulleys 6 are generally fixed pulleys. A positioning piece 7 for positioning the lower runner 44 out of the upper column 41 is rotatably disposed at the bottom end of the upper column 41. The wall of the upper column 41 has an opening 41*a* for the resisting portion 71 of the positioning piece 7 to rotate outside. The positioning piece 7 is positioned inside the upper column 41 in such a way that it can swing telescopically. Generally, the bottom of the positioning piece 7 is positioned with the wall of the upper column 41 by a pin 72 disposed away from the side the resisting portion 71 located. a first spring 8 resists between the wall of the upper column 41 and the back of the resisting portion 71 of the positioning piece 7, so as to make the resisting portion 71 of the positioning piece 7 to keep out of the upper column 41. The first end of the rope 20 is connected to the positioning piece 7, the second end of the rope 20 runs upward throughout the upper column 41 and then downward throughout the transverse rod 2 and the slider 51 to be exposed outside, when the rope 20 is pulled, the positioning piece 7 will rotate into the upper column 41, and the lower runner 44 is capable of moving downward and leave apart the upper column 41 so that the umbrella is folded.

The transverse rod 2 has a shaft hole for the large rib connector 470.

and the drawing rod connector 30 be mounted at the middle portion of the transverse rod 2, the rotating shaft 472 runs through the middle of the large rib connector 470, the end of the drawing rod connector 30 and the shaft hole of the transverse rod 2 so as to make the large rib connector 470 and the drawing rod connector 30 rotatable relative to the transverse rod 2. Generally, both the large rib connector 470 and the drawing rod connector 30 are of a double-clamp structure to facilitate the assembly and connection and to improve the stability and reliability of connection. A stopper 471 in contact with the drawing rod connector 30 is arranged at the tail end of the large rib connector 470. During the open process of the umbrella, when the slider 51 is pushed upward, the drawing rod connector 30 will resist against the stopper 471 and press downward the stopper 471 to drive the large rib connector 470 to rotate about the rotating shaft 472, so as to drive the large rib 47 and the lower runner 44 to move upward relative to the upper column 41 until the umbrella is open. after the umbrella is open, the lower runner 44 is positioned on the upper column 41 by the positioning piece 7, the large rib 47 and the transverse rod 2 are kept unmoved relative to each other, and, when the slider 51 is pulled down until the stopper 471 separates from the drawing rod connector 30, the drawing rod 3 can rotate freely relative to the transverse rod 2, then, the shading angle of the umbrella frame 4 can be adjusted through operating the slider 51 to move up or down along the vertical column 1.

The middle runner 43 is movably disposed on the upper column 41, the outer end of each support rib 48 is rotatably connected to the top of the long rib 45, the inner end of each support rib 48 is rotatably connected to the middle runner 43. A fixed ring 9 is disposed on the upper column 41 below the middle runner 43, and, a second spring 90 is supported between the fixed ring 9 and the middle runner 43. The second spring 90 is provided to support the middle runner 43, so that it is more labor-saving to open the umbrella.

The detail operation is described below.

Figure 4:
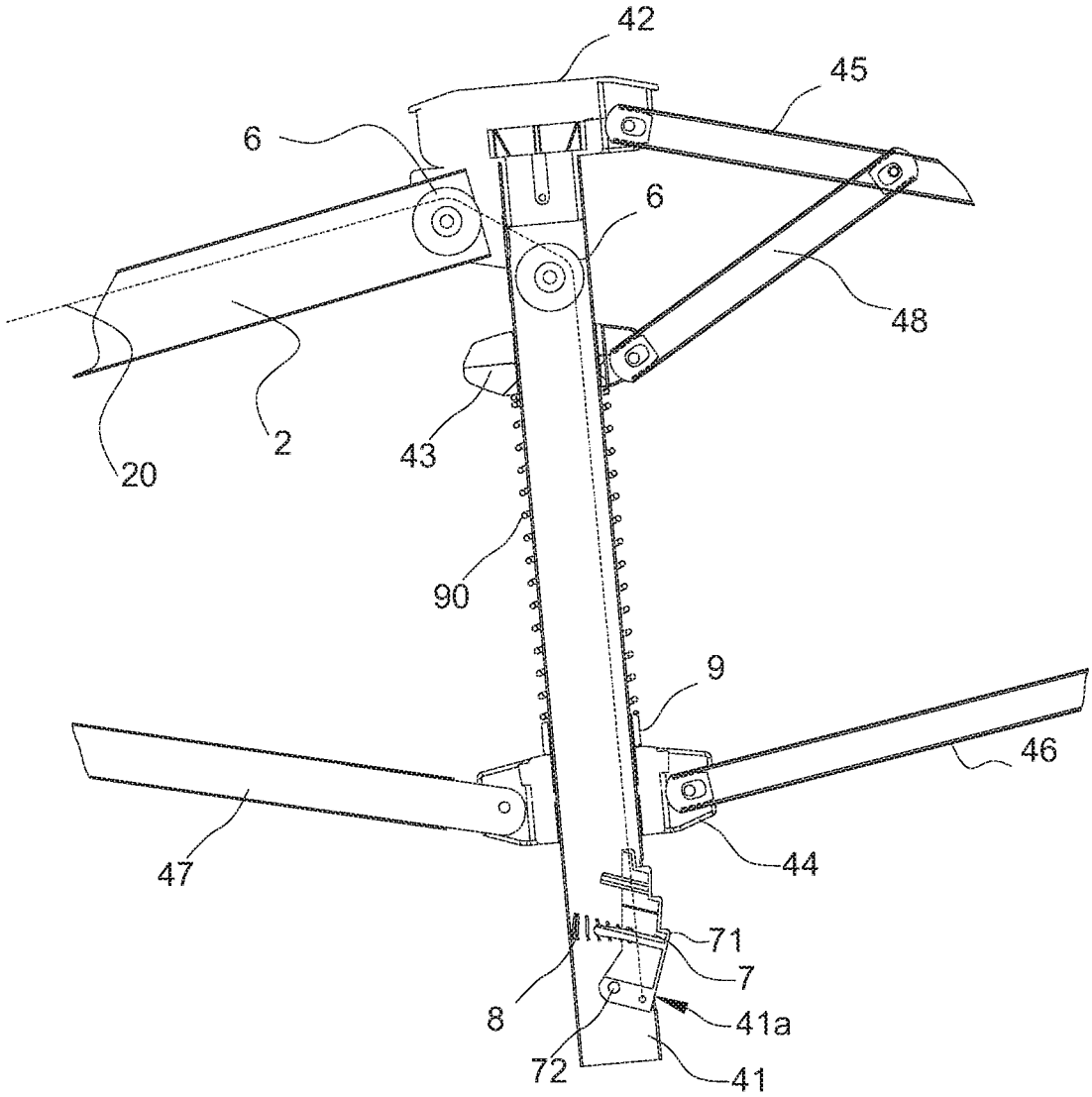
FIG. 4 is a sectional view showing the lower runner is locked by the positioning piece on the upper column according to the embodiment of the present invention.

During the open process of the umbrella, when the slider 51 is pushed upward, the drawing rod connector 30 will resist against the stopper 471 and press downward the stopper 471 to drive the large rib connector 470 to rotate about the rotating shaft 472, so as to drive the large rib 47 and the lower runner 44 to move upward, the short ribs 46 drive the long ribs 45 to rotate upward, the long ribs 45 drive the support ribs 48 to move up, and the support ribs 48 drive the middle runner 43 to move up. At this time, the middle runner 43 undergoes an upward force of the second spring 90, so as to make the support ribs 48, the long ribs 45 and the short ribs 46 to open, therefore, under the function of the second spring 90, it makes the upward movement of the lower runner 44 more labor-saving. When the umbrella is open, the lower runner 44 is positioned on the upper column 41 by the positioning piece 7, as shown in FIG. 4.

Figure 5:
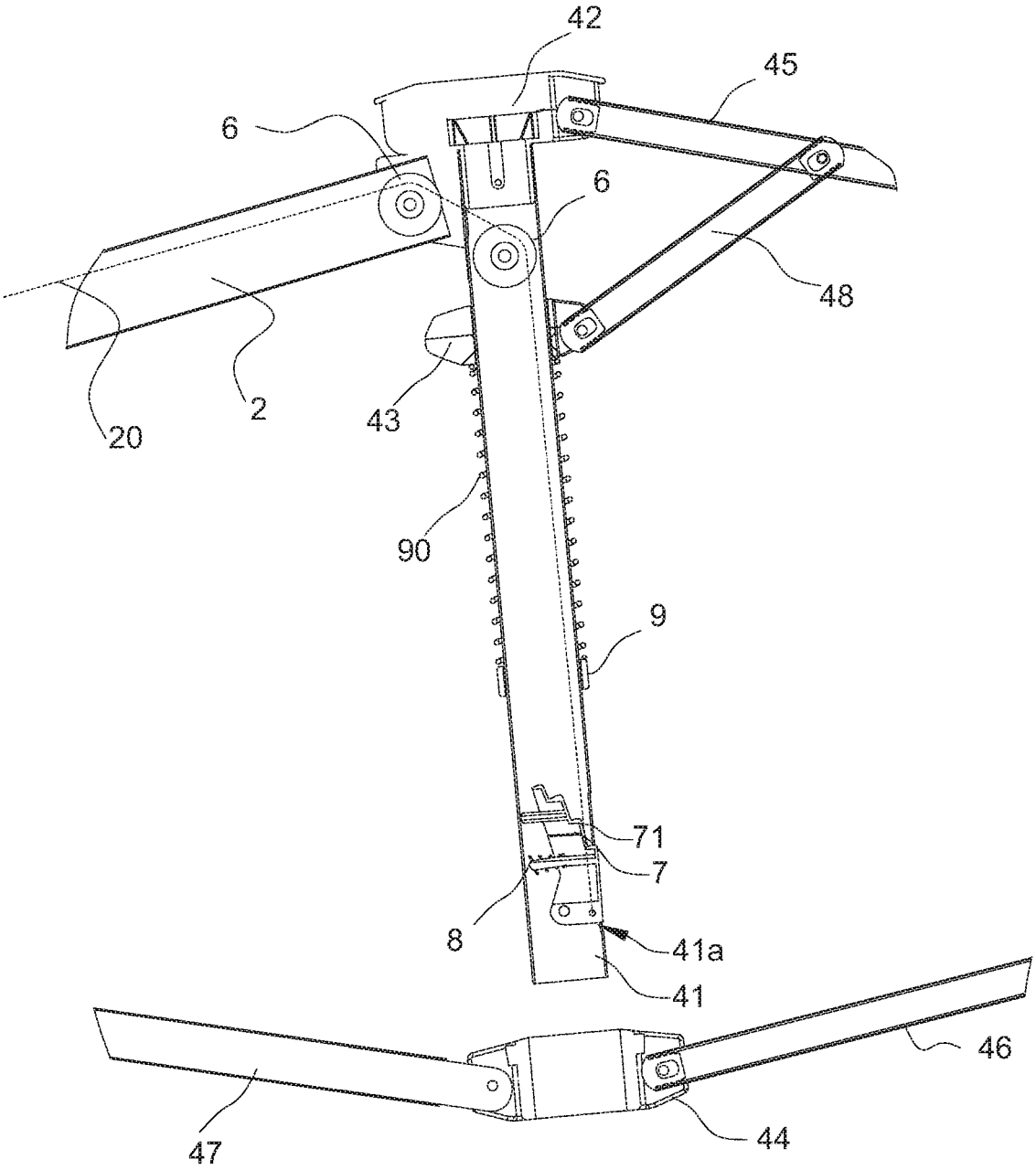
FIG. 5 is a sectional view showing the lower runner is separated from the positioning piece and the upper column according to the embodiment of the present invention.
Figure 6A:
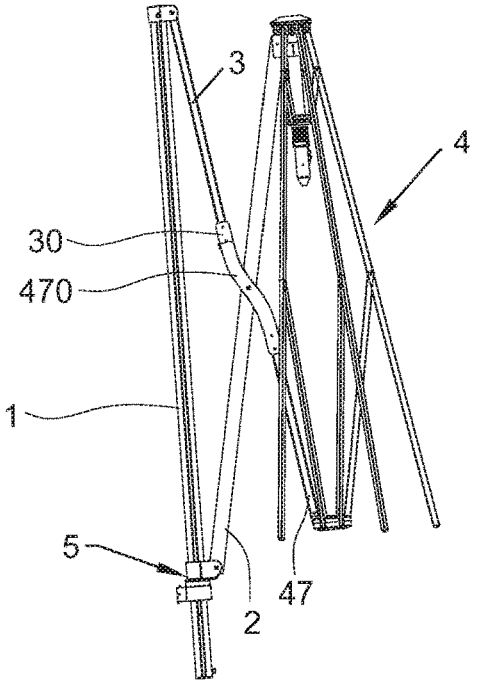
FIG. 6*a* is a front view showing the state of folding over of the umbrella according to the embodiment.
Figure 6B:
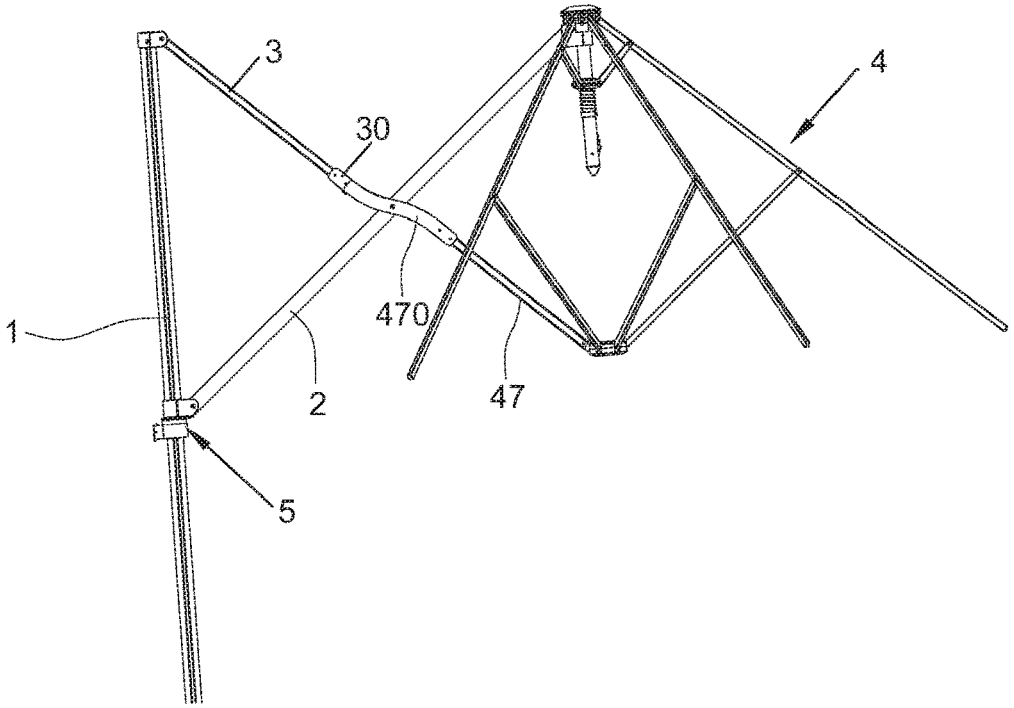
FIG. 6*b* is a front view showing the opening process of the umbrella according to the embodiment.
Figure 6C:
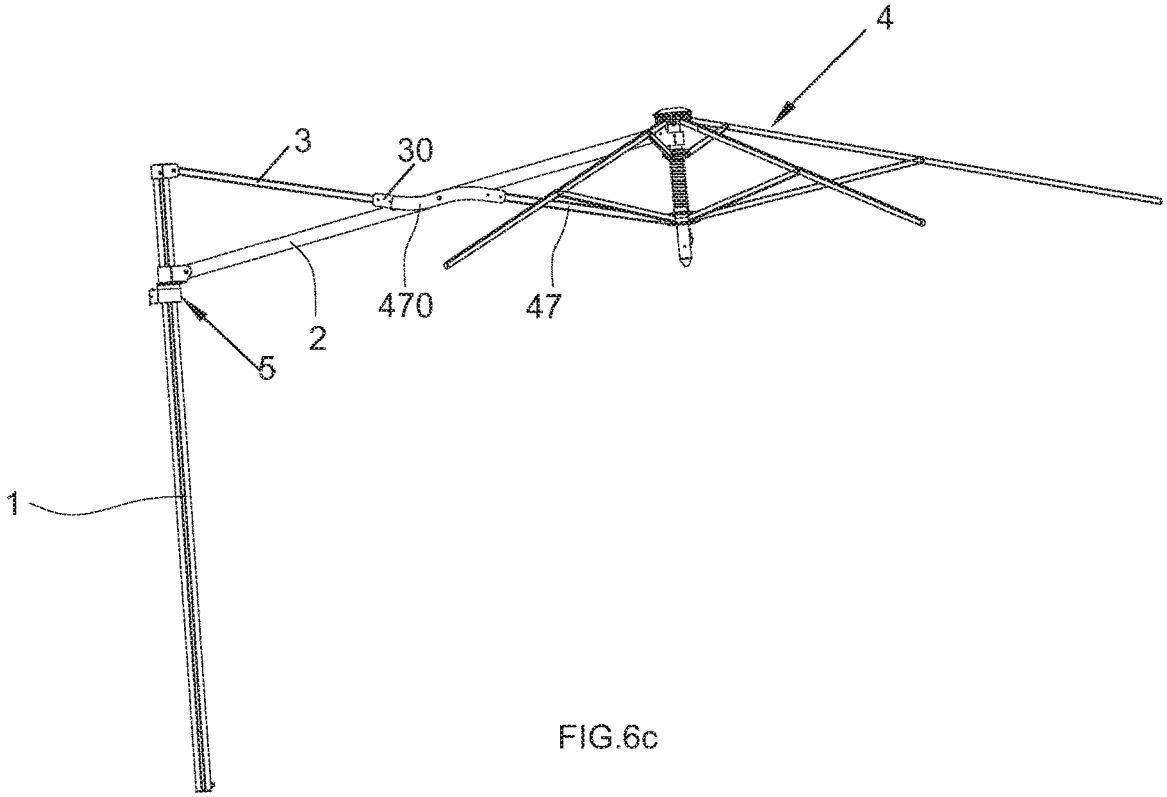
FIG. 6*c* is a front view showing the state of completion of the umbrella according to the embodiment.
Figure 6D:
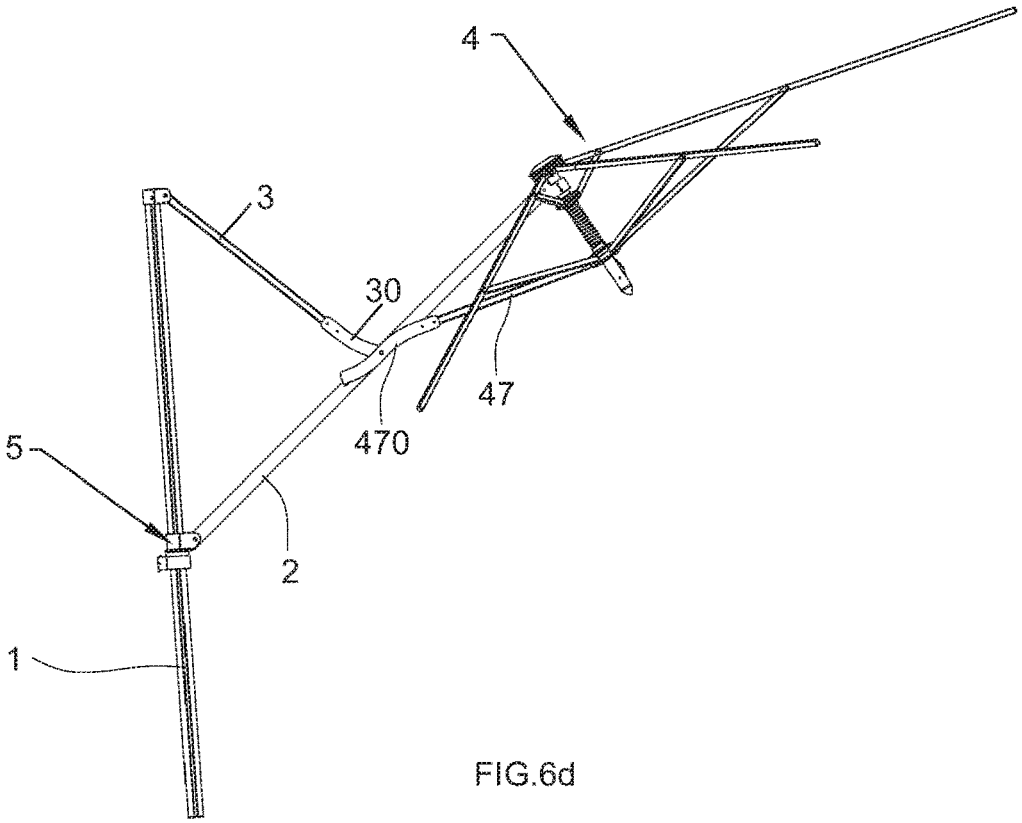
FIG. 6*d* is a front view showing the adjustment of the shading angle of the umbrella according to the embodiment.

As shown in FIG. 5, the rope 20 is pulled, the positioning piece 7 will rotate into the upper column 41, and the lower runner 44 is capable of moving downward and leave apart the upper column 41 so that the umbrella is folded, and the middle runner 43 is moved down to compress the second spring 90.

When it is necessary to adjust the shading angle, it is simply required to press the button 52 so that the latch 53 is separated from the synchronous belt 11, and the slider 51 can slide to adjust the canopy.

Although the preferred embodiments of the present invention have been described above in detail, it should be clearly understood that, for those skilled in the art, various changes and variations of the present invention may be possible. Any modifications, equivalent replacements and improvements made within the spirit and principle of the present invention should fall into the protection scope of the present invention.

What is claimed is:

1. A hand-operated cantilever umbrella, comprising a vertical column (1);

a transverse rod (2) having a top end, a middle portion and a bottom end, the transverse rod sliding along the vertical column;

a drawing rod (3) having a front end and a rear end, the drawing rod being movably hinged to a top of the vertical column;

an umbrella frame (4) hinged to the top end of the transverse rod;

a rope (20) with a first end and a second end running along the transverse rod; and an umbrella adjustment mechanism (5) connected to the transverse rod and sliding along the vertical column, the umbrella adjustment mechanism being capable of adjusting the angle of the umbrella when sliding along the vertical column;

wherein, the front end of the drawing rod (3) is hinged to the middle portion of the transverse rod (2);

the umbrella frame (4) further comprises an upper column (41), an upper runner (42) connected to a top of the upper column, a lower runner (44) sliding along the upper column, a plurality of long ribs (45) movably connected to the upper runner, each long rib having an inner end and a middle portion, a plurality of short ribs (46) movably connected to the lower runner, each short rib having an inner end and an outer end, and a large rib (47) having an inner end and an outer end;

the inner end of each long rib (45) is rotatably connected to the upper runner (42);

the outer end of each short rib (46) is rotatably connected to the middle portion of corresponding long rib (45), and the inner end of each short rib (46) is rotatably connected to the lower runner (44); the outer end of the large rib (47) is rotatably disposed on the middle portion of the transverse rod (2), and the inner end of the large rib (47) is rotatably connected to the lower runner (44);

the umbrella adjustment mechanism (5) further comprises a slider (51) movably disposed on the vertical column (1), a large rib connector (470) being rotatable around a rotating shaft (472) disposed on the middle portion of the transverse rod (2), and a drawing rod connector (30) rotatably disposed on the middle portion of the transverse rod (2);

the slider (51) is capable of sliding up and down, the bottom end of the transverse rod (2) is hinged to the slider (51);

the outer end of the large rib (47) is connected to the large rib connector (470), the front end of the drawing rod (3) is connected to the drawing rod connector (30) to be rotatably connected to the transverse rod (2);

the large rib connector (470) has a stopper (471) resisting against the drawing rod connector (30), when the slider (51) is pushed upward, the drawing rod connector (30) will resist against the stopper (471) and press downward the stopper (471) to drive the large rib connector (470) to rotate about the rotating shaft (472), so as to drive the large rib (47) and the lower runner (44) to move upward relative to the upper column (41) until the umbrella is open;

a positioning piece (7) for positioning the lower runner (44) out of the upper column (41) is rotatably disposed at the bottom end of the upper column (41), the positioning piece (7) is capable of rotating between inside and outside the upper column (41);

the first end of the rope (20) is connected to the positioning piece (7), the second end of the rope (20) runs upward throughout the upper column (41) and then downward throughout the transverse rod (2) and the slider (51) to be exposed outside, when the rope (20) is pulled, the positioning piece (7) will rotate into the upper column (41), and the lower runner (44) is capable of moving downward and leave apart the upper column (41) so that the umbrella is folded.

2. The umbrella of claim 1, wherein the upper column (41) is hollow and has an annular wall, the positioning piece (7) has a resisting portion (71) at a middle of the positioning piece (7);

the wall of the upper column (41) has an opening (41*a*) for the resisting portion (71) of the positioning piece (7) to rotate outside, the positioning piece (7) is positioned inside the upper column (41), and, a first spring (8) resists between the wall of the upper column (41) and the back of the resisting portion (71) of the positioning piece (7), so as to make the resisting portion (71) of the positioning piece (7) to keep out of the upper column (41).

3. The umbrella of claim 2, wherein the transverse rod (2) is hollow; three pulleys (6) are respectively disposed inside the top end and the bottom end of the transverse rod (2) and inside the top of the upper column (41);

the rope (20) runs through all the pulleys (6) in the transverse rod (2) and the upper column (41) to be connected to the bottom of the positioning piece (7) at the side the resisting portion (71) located, and the bottom of the positioning piece (7) is positioned with the wall of the upper column (41) by a pin (72) disposed away from the side the resisting portion (71) located.

4. The umbrella of claim 3, wherein the transverse rod (2) has a shaft hole for the large rib connector (470) and the drawing rod connector (30) be mounted at the middle portion of the transverse rod (2), the rotating shaft (472) runs through the middle of the large rib connector (470), the end of the drawing rod connector (30) and the shaft hole of the transverse rod (2) so as to make the large rib connector (470) and the drawing rod connector (30) rotatable relative to the transverse rod (2);

the stopper (471) and the outer end of the large rib (47) are respectively located at two sides of the rotating shaft (472);

during the open process of the umbrella, the drawing rod (3) and the large rib (47) rotates together;

after the umbrella is open, the lower runner (44) is positioned on the upper column (41) by the positioning piece (7), the large rib (47) and the transverse rod (2) are kept unmoved relative to each other, and, when the slider (51) is pulled down until the stopper (471) separates from the drawing rod connector (30), the drawing rod (3) can rotate freely relative to the transverse rod (2), then, the shading angle of the umbrella frame (4) can be adjusted through operating the slider (51) to move up or down along the vertical column (1).

5. The umbrella of claim 4, wherein the umbrella frame (4) further comprises a middle runner (43) and multiple support ribs (48) each having an outer end and an inner end;

the middle runner (43) is movably disposed on the upper column (41), the outer end of each support rib (48) is rotatably connected to the top of the long rib (45), the inner end of each support rib (48) is rotatably connected to the middle runner (43);

a fixed ring (9) is disposed on the upper column (41) below the middle runner (43), and, a second spring (90) is supported between the fixed ring (9) and the middle runner (43).

6. The umbrella of claim 1, wherein the umbrella adjustment mechanism (5) further comprises a button (52) movably disposed on the slider (51) exposed outside and a latch (53) disposed inside the slider (51);

the vertical column (1) has a vertical synchronous belt (11) inside the vertical column (1);

the latch (53) is transversely movable, a first end (53*a*) of the latch (53) is pin jointed with the top of the button (52), a second end (53*b*) of the latch (53) can be locked with the synchronous belt (11) or separated from the synchronous belt (11) driven by the movement of the button (52), accordingly, the slider (51) is positioned on the vertical column (1) through the latch (53) locked with the synchronous belt (11).

7. The umbrella of claim 6, wherein the slider (51) has a mounting recess (51*a*) for receiving the button (52), the middle of the button (52) is rotatably mounted on the slider (51) through a connecting pin (52*a*);

and, a third spring (54) is supported between the inner side of the bottom of the button (52) and the slider (51), so that the top of the button (52) and the first end (53*a*) of the latch (53) are kept to move forward and push the second end (53*b*) of the latch (53) locked with the synchronous belt (11).

8. The umbrella of claim 7, wherein the slider (51) is a sliding sleeve which surrounds around the vertical column (1) and is slidable up and down.

9. The umbrella of claim 1, wherein a top cap (10) is arranged on the top of the vertical column (1), and the rear end of the drawing rod (3) is hinged to the top cap (10).

* * * * *